US011857821B2

(12) United States Patent
Chen et al.

(10) Patent No.: US 11,857,821 B2
(45) Date of Patent: Jan. 2, 2024

(54) RESISTANCE DEVICE AND RESISTANCE TRAINING MACHINE HAVING THE RESISTANCE DEVICE

(71) Applicant: Acufit Enterprise Co., Ltd., Taichung (TW)

(72) Inventors: Sen-Fa Chen, Taichung (TW); Yao-Neng Chen, Taichung (TW); Nan-Ping Fu, Taichung (TW); Yi-Hsuan Kuang, Taichung (TW)

(73) Assignee: ACUFIT ENTERPRISE CO., LTD., Taichung (TW)

( * ) Notice: Subject to any disclaimer, the term of this patent is extended or adjusted under 35 U.S.C. 154(b) by 46 days.

(21) Appl. No.: 17/658,805

(22) Filed: Apr. 11, 2022

(65) Prior Publication Data

US 2023/0233896 A1 Jul. 27, 2023

(30) Foreign Application Priority Data

Jan. 26, 2022 (TW) ..... 111103406

(51) Int. Cl.
*A63B 21/005* (2006.01)
*A63B 24/00* (2006.01)
*A63B 23/04* (2006.01)

(52) U.S. Cl.
CPC ..... *A63B 21/0051* (2013.01); *A63B 24/0087* (2013.01); *A63B 23/0405* (2013.01); *A63B 2023/0411* (2013.01)

(58) Field of Classification Search
CPC ..... A63B 21/0051; A63B 24/0087; A63B 23/0405; A63B 2023/0411; A63B 21/153;
(Continued)

(56) References Cited

U.S. PATENT DOCUMENTS 5,180,348 A * 1/1993 Saarinen ..... A63B 21/153 482/903
5,433,678 A * 7/1995 Chi ..... A63B 21/0058 482/99

(Continued)

FOREIGN PATENT DOCUMENTS

TW M456829 U 7/2013
TW M564461 U 8/2018
TW M626655 U 5/2022

OTHER PUBLICATIONS

A Search Report appended to an Office Action, which was issued to Taiwanese counterpart application No. 111103406 by the TIPO dated Jul. 15, 2022, with an English translation thereof.

*Primary Examiner* — Andrew S Lo
*Assistant Examiner* — Andrew M Kobylarz
(74) *Attorney, Agent, or Firm* — Lewis Roca Rothgerber Christie LLP

(57) ABSTRACT

A resistance device includes a first rotating assembly having a first rotating member, and a second rotating assembly having a second rotating member and a plurality of magnets. A transmission unit is connected to one of the rotating assemblies for driving rotation of the same. A drive unit is connected to the other one of the rotating assemblies, is configured to receive a control signal, and is configured to drive rotation of the other one of the rotating assemblies according to the received control signal. Eddy currents generated by the first rotating member provide resistance to the transmission unit. A resistance training machine having the resistance device is also disclosed.

8 Claims, 9 Drawing Sheets

(58) Field of Classification Search
CPC ... A63B 69/16; A63B 21/225; A63B 23/0476; A63B 2069/165; A63B 2225/30; Y10S 482/903
See application file for complete search history.

(56) References Cited

U.S. PATENT DOCUMENTS 5,433,681 A * 7/1995 Minoura ..... A63B 21/0051 482/61
5,944,638 A * 8/1999 Maresh ..... A63B 22/0605 482/110

* cited by examiner

RESISTANCE DEVICE AND RESISTANCE TRAINING MACHINE HAVING THE RESISTANCE DEVICE

CROSS-REFERENCE TO RELATED APPLICATION

This application claims priority from Taiwanese Patent Application No. 111103406, filed on Jan. 26, 2022.

FIELD

The disclosure relates to an exercise apparatus, more particularly to a resistance device that uses the principle of an eddy current brake and a resistance training machine having the resistance device.

BACKGROUND

Resistance training is a training method that strengthens the muscle strength and motor function of a human body by making the muscles resist external resistance. Through a resistance training machine that can adjust the amount of exercise resistance, in addition to training specific muscle groups, an appropriate resistance value can also be adjusted, so that the resistance training can be more efficient to achieve a better fitness effect. Apart from sports and fitness, the resistance training is also often used in the field of rehabilitation medicine, and is beneficial for postoperative muscle recovery, improvement of disability caused by insufficient muscle strength, or in conjunction with the treatment of neurological diseases.

An existing resistance training machine, for example, a leg press machine (not shown), includes a weight stack assembly, a seat, and a foot plate connected to the weight stack assembly. The weight stack assembly can allow a user to connect different weight and number of weight bars to a weight stack rod through a pin so as to adjust the amount of resistance of the leg press machine. In operation, a user sits on the seat and uses his feet to push the foot plate away from the seat. At this time, the selected weight bars of the weight stack assembly will be lifted to provide resistance to the user through the foot plate. When the user reduces the force against the foot plate and relaxes, the foot plate will be moved back to an original position close to the seat by the gravity of the stacked weight bars, and the selected weight bars will slide down to the initial position at the same time. In this way, the user can repeatedly move the foot plate away from and close to the seat for resistance training.

Since the resistance of the existing resistance training machine can only be adjusted mechanically by hand, the training is interrupted for each adjustment, so that the existing resistance training machine is inconvenient to use. Further, when the user is fully relaxed without supporting the foot plate as the foot plate moves toward the seat, the selected weight bars will be affected by gravity and collide with each other to cause noise. Hence, there is still room for improvement of the existing resistance training machine.

SUMMARY

Therefore, an object of the present disclosure is to provide a resistance device that can be adjusted and that can provide continuous resistance during training.

According to one aspect of this disclosure, a resistance device comprises a first rotating assembly, a second rotating assembly, a transmission unit, and a drive unit. The first rotating assembly is rotatable about an axis, and includes a first rotating member that is conductive. The second rotating assembly includes a second rotating member spaced from the first rotating member, and a plurality of magnets arranged on the second rotating member at intervals around the axis. N and S poles of the magnets are alternately arranged on the second rotating member and face the first rotating member. The first rotating member is influenced by the magnets to generate eddy currents during rotation of the first and second rotating assemblies relative to each other in order to brake rotation of the same.

The transmission unit is connected to one of the first and second rotating assemblies for driving rotation of the same. The drive unit is connected to the other one of the first and second rotating assemblies, is configured to receive a control signal, and is configured to drive rotation of the other one of the first and second rotating assemblies according to the received control signal. The eddy currents generated by the first rotating member during rotation of the first and second rotating assemblies relative to each other provide resistance to the transmission unit.

Another object of this disclosure is to provide a resistance training machine having the above resistance device.

According to another aspect of this disclosure, a resistance training machine comprises a base, an operating device disposed on the base, and the resistance device disposed on the base. The transmission unit of the resistance device is connected to the operating device for providing resistance to operation of the same.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
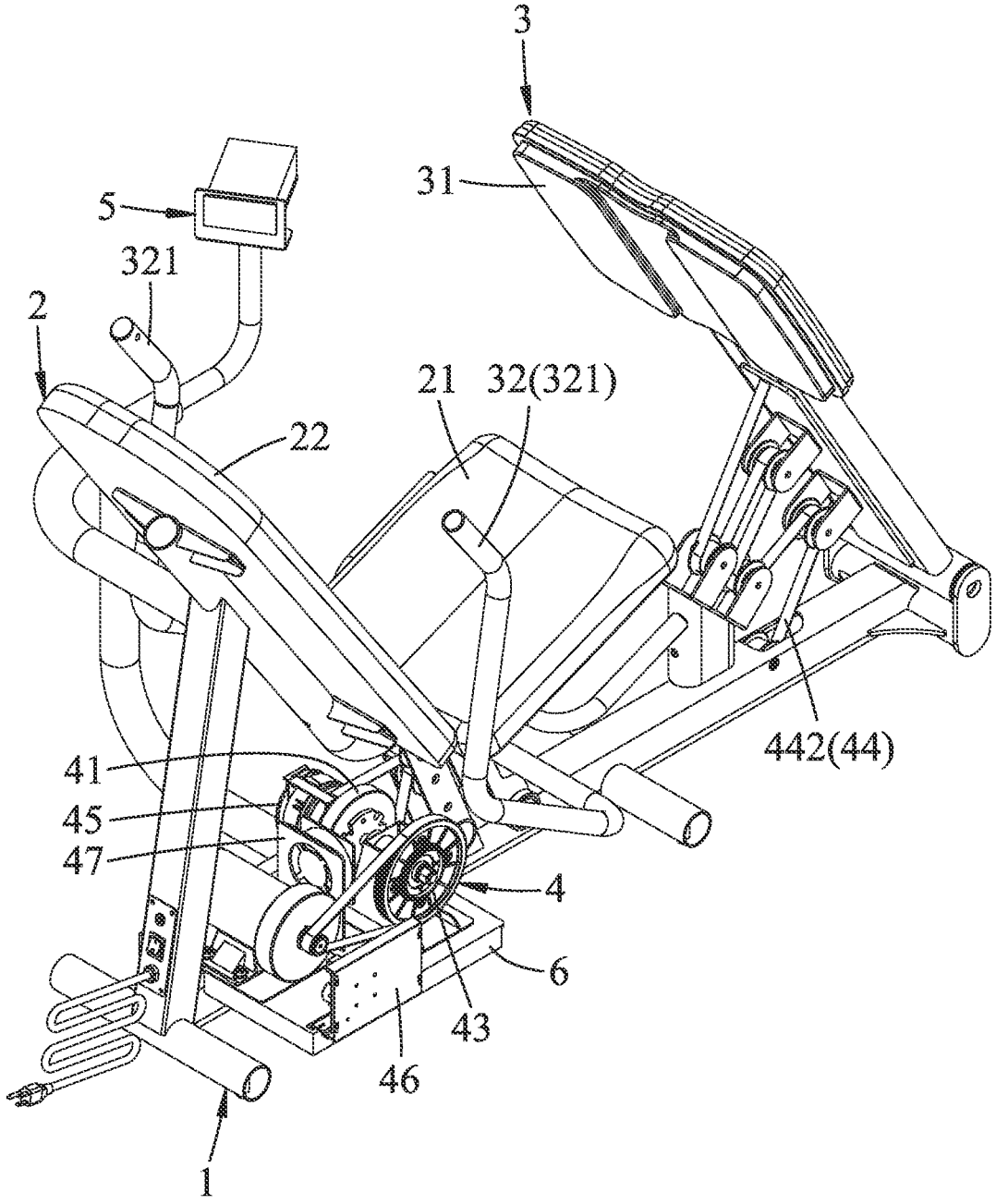
FIG. 1 is a perspective view of a resistance training machine according to the first embodiment of the present disclosure.
Figure 2:
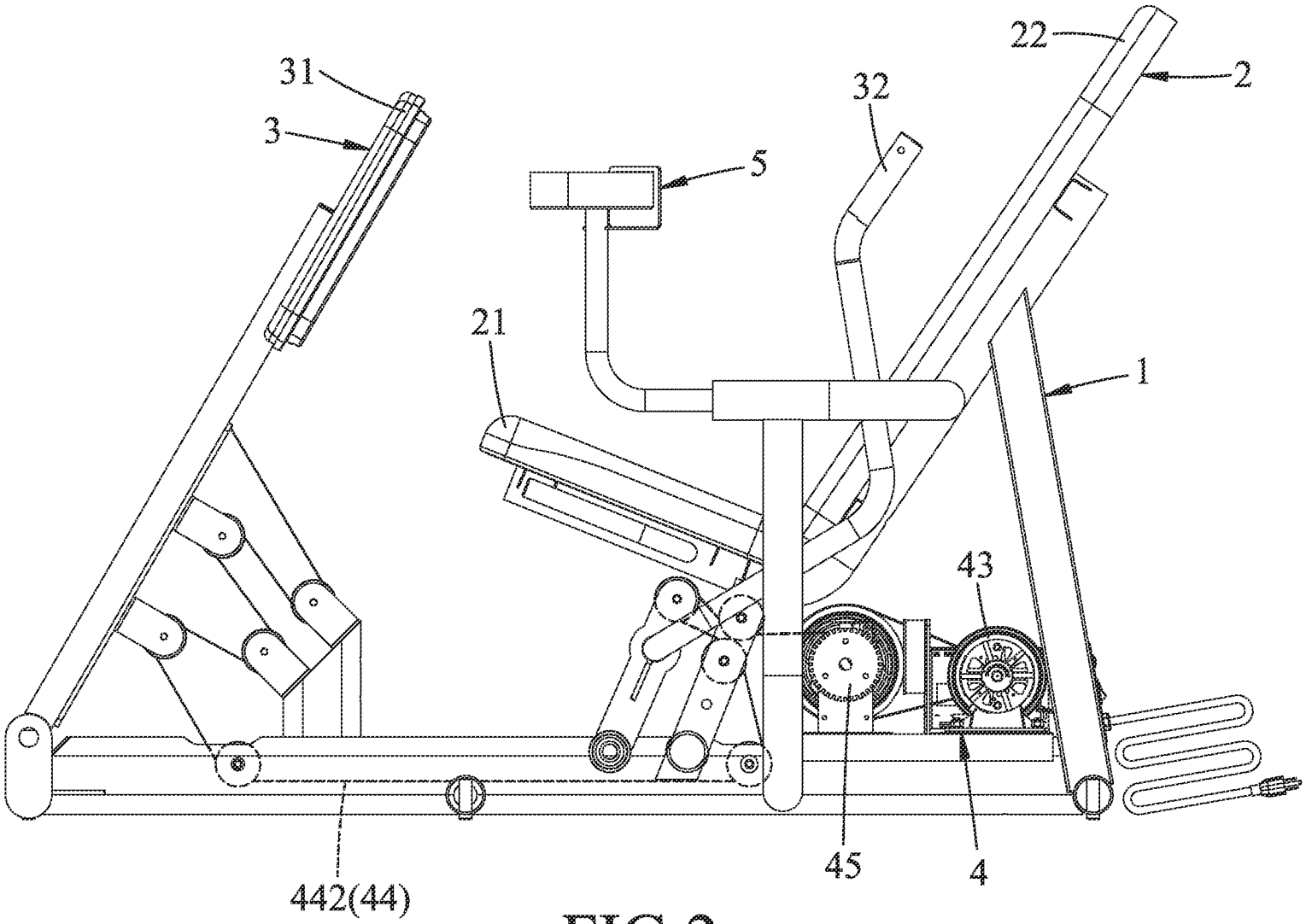
FIG. 2 is a side view of the first embodiment.
Figure 3:
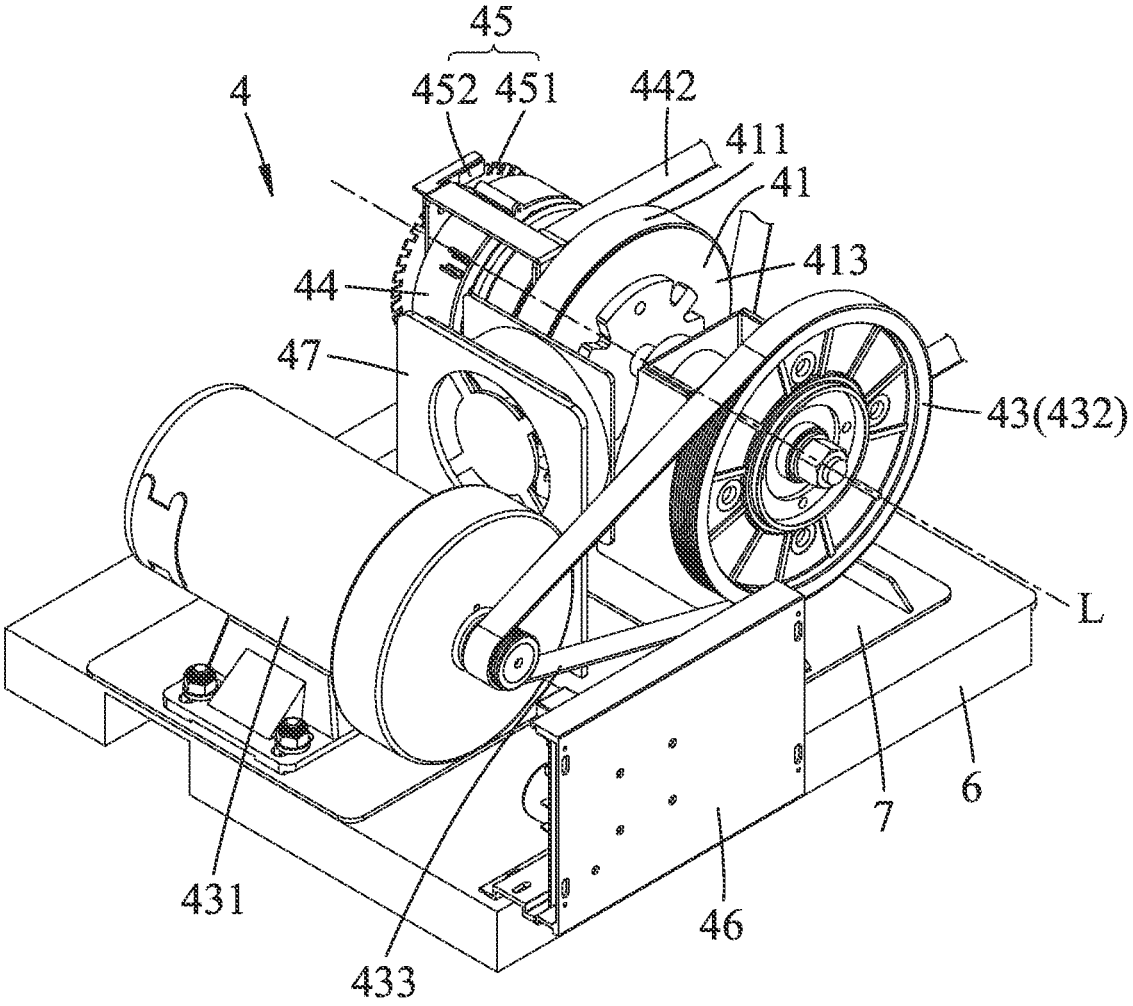
FIG. 3 is a perspective view of a resistance device of the first embodiment.
Figure 4:
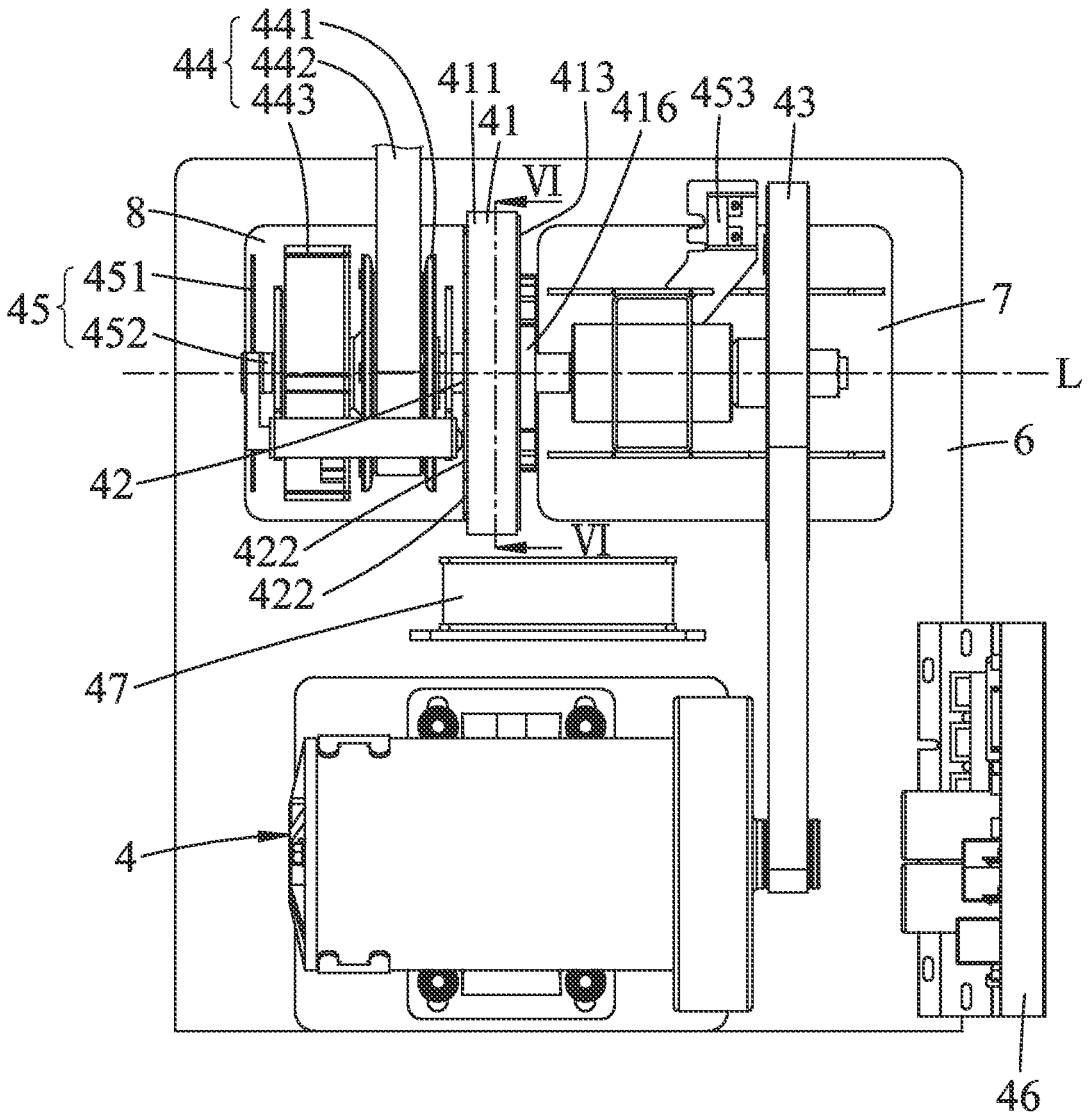
FIG. 4 is a top view of the resistance device of the first embodiment.
Figure 5:
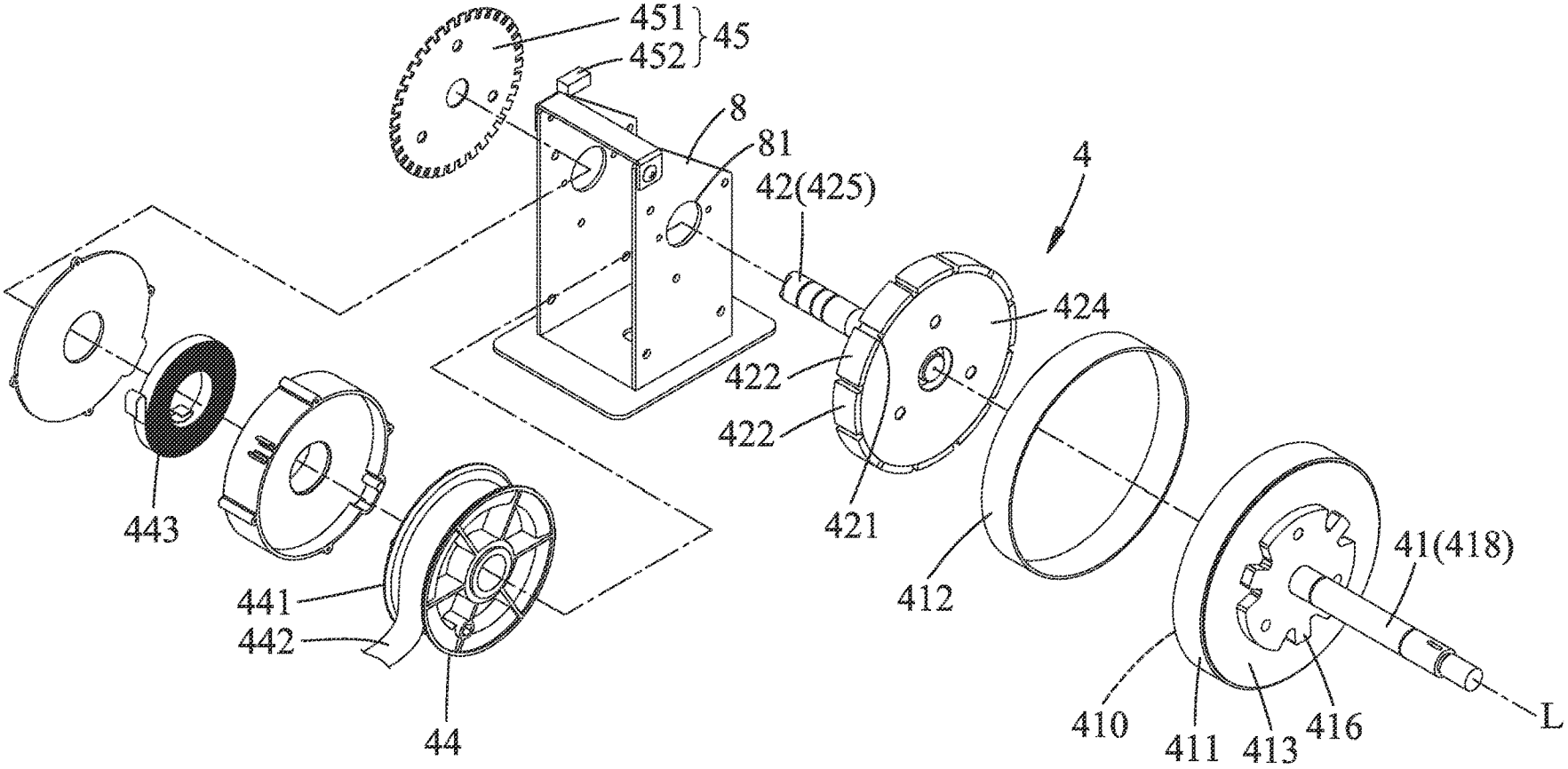
FIG. 5 is an exploded perspective view of the resistance device of the first embodiment.
Figure 6:
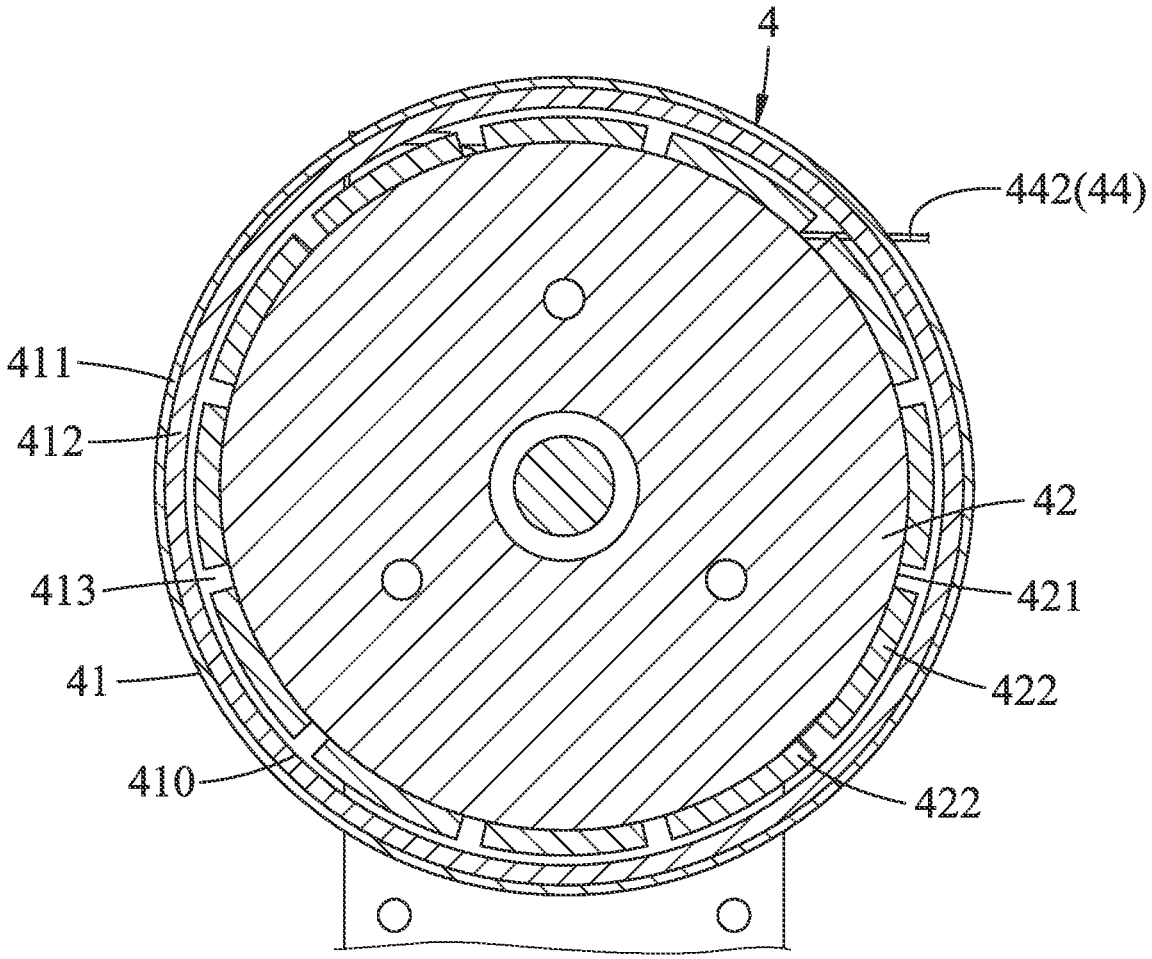
FIG. 6 is a sectional view taken along line VI-VI of FIG. 4.

Before the present disclosure is described in greater detail, it should be noted herein that like elements are denoted by the same reference numerals throughout the disclosure.

Referring to FIGS. 1 to 6, a resistance training machine according to the first embodiment of the present disclosure is shown to comprise a base 1, an operating device 3, a resistance device 4, and a meter device 5. The resistance training machine can be provided with or without a seat 2 according to the actual requirement.

In this embodiment, the seat 2 is disposed on the base 1, and includes a seat portion 21 and a backrest portion 22 connected as one body. However, in other embodiments, to match the different resistance training methods, the seat portion 21 and the backrest portion 22 may be separately adjustable, or the seat 2 may only include the seat portion 21. The structure of the seat 2 is not limited to the disclosed embodiment. Still in other embodiments, if the resistance training machine is not provided with the seat 2, training is provided in a standing position only.

The operating device 3 includes a foot plate assembly 31 and a handle assembly 32 that are disposed on the base 1 and that are spaced apart from and opposite to each other. When a user (not shown) is seated on the seat 2, he can use his feet to push the foot plate assembly 31 away from the seat 2. The handle assembly 32 includes two handles 321 located on two opposite sides of the seat 2. When the user is seated on the seat 2, he can use his hands to push the handles 321 away from the seat 2.

It should be noted that, if the resistance training machine is not provided with the seat 2, the foot plate assembly 31 may be pushed backward by the user in a standing position, and the handles 321 may be pushed upward and downward, forward and rearward, or toward and away from each other by the user. The operating device 3 may further include a leg rest assembly (not shown) for the lower legs of the user to push up or down. As long as the user can reciprocate the operation, any form of resistance training falls within the scope of this disclosure.

With reference to FIGS. 3 to 6, in combination with FIG. 1, the resistance device 4 includes a support plate 6 fixed to the base 1, a first mounting seat 7 and a second mounting seat 8 fixed to the support plate 6 and adjacent to each other, a first rotating assembly 41, a second rotating assembly 42, a drive unit 43, a transmission unit 44, a sensing unit 45, a control unit 46, and a heat dissipating fan 47.

The first rotating assembly 41 is rotatably mounted on the first mounting seat 7 for rotation about an axis (L), and includes an annular ring 411, a first rotating member 412, an end plate 413, a connecting plate 416, and a shaft 418. The annular ring 411 surrounds the axis (L), and is made of a magnetic conductive material, such as iron. The annular ring 411 has an outer peripheral edge connected to an outer periphery of the end plate 413. In this embodiment, the first rotating member 412 is a rotating ring that has an outer peripheral edge connected to the end plate 413, that has an outer peripheral surface abutting against an inner peripheral surface of the annular ring 411, and that is made of a conductive material, such as aluminum, copper, aluminum alloy or copper alloy. The end plate 413 and the annular ring 411 cooperatively define a receiving space 410. The connecting plate 416 is connected to the end plate 413 at a side opposite to the annular ring 411 and the first rotating member or ring 412. The shaft 418 is connected to and extends outwardly from the connecting plate 416 along the axis (L), and is rotatably inserted through a top portion of the first mounting seat 7 for connection with the drive unit 43.

The second rotating assembly 42 is mounted on the second mounting seat 8, and includes a second rotating member 421, a plurality of magnets 422, an end plate 424, and a shaft 425. In this embodiment, the second rotating member 421 is a rotating ring that has an outer peripheral edge connected to an outer periphery of the end plate 424, that is disposed in the receiving space 410, and that is not connected to the end plate 413. Further, the second rotating member or ring 421 is spaced apart from the first rotating ring 412.

The magnets 422 of this embodiment are disposed on an outer peripheral surface of the second rotating ring 421, and are arranged thereon at intervals around the axis (L). N and S poles of the magnets 422 are alternately arranged around the outer peripheral surface of the second rotating ring 421, and face an inner peripheral surface of the first rotating ring 412. Each magnet 422 is spaced apart from the first rotating ring 412 by a radial gap of, for example, 2 mm. The magnets 422 are strong magnets, for example, neodymium (NdFeB) magnets. The number of the magnets 422 used in this embodiment is twelve, but is not limited thereto, and may be increased or decreased according to the actual requirements.

The shaft 425 extends inwardly from the end plate 424 along the axis (L), and is rotatably inserted through a pair of aligned holes 81 in the second mounting seat 8 for rotation about the axis (L).

In other embodiments, the position of the annular ring 411, the first rotating ring 412 and the second rotating ring 421 may be interchanged. That is, the second rotating ring 421 is located on the outermost side, and is subsequently followed by the first rotating ring 412 and the annular ring 411. At this time, the second rotating ring 421 surrounds an outer peripheral surface of the first rotating ring 412 with an inner peripheral surface thereof facing the outer peripheral surface of the first rotating ring 412, the magnets 422 are disposed on the inner peripheral surface of the second rotating ring 421, and the first rotating ring 412 abuts against an outer peripheral surface of the annular ring 411.

The drive unit 43 may be connected to the first or second rotating assembly 41, 42. In this embodiment, the drive unit 43 connected to the first rotating assembly 41 will be described herein. The drive unit 43 includes a motor 431 mounted on the support plate 6, a driven wheel 432 fixed to the shaft 418, and a belt 433 wrapped around a pulley of the motor 431 and the driven wheel 432. The motor 431 serves to rotate the driven wheel 432 through the belt 433. The shaft 418 rotates together with the driven wheel 432, and drives the annular ring 411, the first rotating ring 412 and the end plate 413 to rotate therewith. The drive unit 43 is configured to receive a control signal, and is configured to drive rotation of the first rotating assembly 41 about the axis (L) according to the received control signal.

During rotation of the first rotating assembly 41 relative to the second rotating assembly 42, eddy currents are generated in the first rotating ring 412 through the relative rotation of the conductive first rotating ring 412 and the magnets 422. Since the magnetic field generated by the eddy currents will cause the magnetic field generated by the magnets 422 to change, a tangential component force opposite to a moving direction is generated. Through this, a mutual braking resistance between the first and second rotating assemblies 41, 42 is created.

It should be noted that the eddy currents are generated by the fact that the magnetic field lines of the magnets 422 are cut when the conductive first rotating ring 412 is rotated. In this embodiment, since the annular ring 411 is a magnetic conductor and is located on a side of the first rotating ring 412 opposite to the magnets 422, it can guide the magnetic field lines of the magnets 422 to concentrate and pass through the first rotating ring 412, and improve the effect of cutting the magnetic field lines of the magnets 422 when the first rotating ring 412 is rotated, thereby increasing the magnitude of the eddy currents and the resistance generated. Alternatively, the first rotating assembly 41 may not include the annular ring 411, and can still achieve the effect of generating eddy currents and resistance.

With reference to FIGS. 2 to 5, the transmission unit 44 may be connected to the first or second rotating assembly 41, 42. In this embodiment, the transmission unit 44 connected to the second rotating assembly 42 will be described herein. In other embodiments, the positions of the first and second rotating assemblies 41, 42 may be interchanged such that the first rotating assembly 41 is connected to the transmission unit 44, while the second rotating assembly 42 is connected to the drive unit 43.

The transmission unit 44 includes a transmission wheel 441 sleeved fixedly on the shaft 425, a transmission belt 442 wound on the transmission wheel 441, and a restoring member 443 connected to the transmission wheel 441. The transmission belt 442 has one end connected to the transmission wheel 441, and the other end connected to the foot plate assembly 31 and the handle assembly 32 of the operating device 3 and can be pulled out of the transmission wheel 441 by the foot plate assembly 31 or the handle assembly 32 so as to drive the transmission wheel 441 to rotate, which in turn, drives the second rotating assembly 42 to rotate therewith.

The restoring member 443 provides a restoring force to drive the transmission wheel 441 to wind back the transmission belt 442. The restoring member 443 may be a volute spiral spring. When the user pushes the foot plate assembly 31 or the handle assembly 32 away from the seat 2, the restoring member 443 stores a restoring force for moving the foot plate assembly 31 or the handle assembly 32 close to the seat 2 via the transmission belt 442. The user needs only to stop applying force after pushing the foot plate assembly 31 or the handle assembly 32 to release the stored restoring force of the restoring member 443, and the foot plate assembly 31 or the handle assembly 32 will automatically move close to the seat 2 through the restoring member 443. Hence, the foot plate assembly 31 or the handle assembly 32 can be repeatedly moved away from and close to the seat 2 through the restoring member 443.

The sensing unit 45 includes a light interrupting disc 451 fixedly connected to the shaft 425 of the second rotating assembly 42, and a photo interrupter fixed to a top portion of the second mounting seat 8 and corresponding to the light interrupting disc 451. The light interrupting disc 451 rotates together with the shaft 425 when the shaft 425 is driven by the transmission unit 44 to rotate, so that the light interrupting disc 451 is coaxial with the transmission wheel 441 and rotates at the same speed with the same. The photo interrupter 452 is used for sensing the rotation of the light interrupting disc 451 to know the pulling length, the speed and the number of times of repeated pulling of the transmission belt 442. In other embodiments, the light interrupting disc 451 may have an axis or speed different from that of the transmission wheel 441, and may rotate relative to the transmission wheel 441 at a predetermined speed ratio through a set of connecting elements (not shown, for example, several gears). In such case, the sensed amount of rotation of the light interrupting disc 451 can be obtained according to the predetermined rotation speed ratio, and the pulling length of the transmission belt 442 and the speed and the number of times of repeated pulling of the transmission belt 442 can be calculated.

The sensing unit 45 further includes a speed sensor 453 (see FIG. 4) fixed to the first mounting seat 7 and proximate to the drive unit 43 for sensing the rotational speed of the driven wheel 432 of the drive unit 43.

The control unit 46 is disposed on the support plate 6, and is communicably connected to the drive unit 43 for sending a control signal thereto. Through this, the rotational speed of the drive unit 43 for driving rotation of the first rotating assembly 41 can be controlled and adjusted, thereby adjusting the magnitude of the eddy current resistance between the first and second rotating assemblies 41, 42. It should be noted herein that, because the rotational speed of the first rotating assembly 41 driven by the drive unit 43 is higher than the rotational speed of the second rotating assembly 42 driven by manpower, the magnitude of resistance is mainly determined by the rotational speed of the first rotating assembly 41, and is mainly controlled by the control unit 46. Through this, only by setting the operating program of the control unit 46, the rotational speed of the first rotating assembly 41 can be adjusted according to the user's setting to change the magnitude of the resistance.

The heat dissipating fan 47 is disposed on the support plate 6 in proximity to the first and second rotating assemblies 41, 42 for dissipating heat generated by the same. When the first and second rotating assemblies 41, 42 rotate at a relatively high speed relative to each other, they will generate heat, so that the magnetic force of the magnets 422 will be reduced, thereby affecting the generation of the eddy currents and the magnitude of resistance. Therefore, through the provision of the heat dissipating fan 47, heat dissipation can be enhanced to help maintain a stable resistance.

The meter device 5 is communicably connected to the photo interrupter 452 and the speed sensor 453, and is used to display sensing information for the user's reference, for example, the information obtained by the photo interrupter 452 by sensing the amount of rotation of the light interrupting disc 451, such as the pulling length, the speed and the repeated pulling times of the transmission belt 442, or the rotational speed information sensed by the speed sensor 453. The information displayed on the meter device 5 can be used as a reference for the user during resistance training, so that the convenience of use can be improved, and at the same time, a suitable training plan can be made through the above information, thereby improving the effectiveness of training.

Additionally, in this embodiment, the control signal sent by the control unit 46 and the related information sensed by the sensing unit 45 are both transmitted and integrated through digital signals. However, in other embodiments, the control unit 46 may be integrated with the meter device 5, for example, through a control panel (not shown) for the user to monitor the information and adjust the resistance, or by communicably connecting the control unit 46 and the sensing unit 45 to a remote software program which may be, for example, a mobile phone APP, so that functions, such as monitoring of the information and adjusting of the resistance, may be performed through a mobile phone, thereby further improving the convenience of use of this embodiment.

Figure 7:
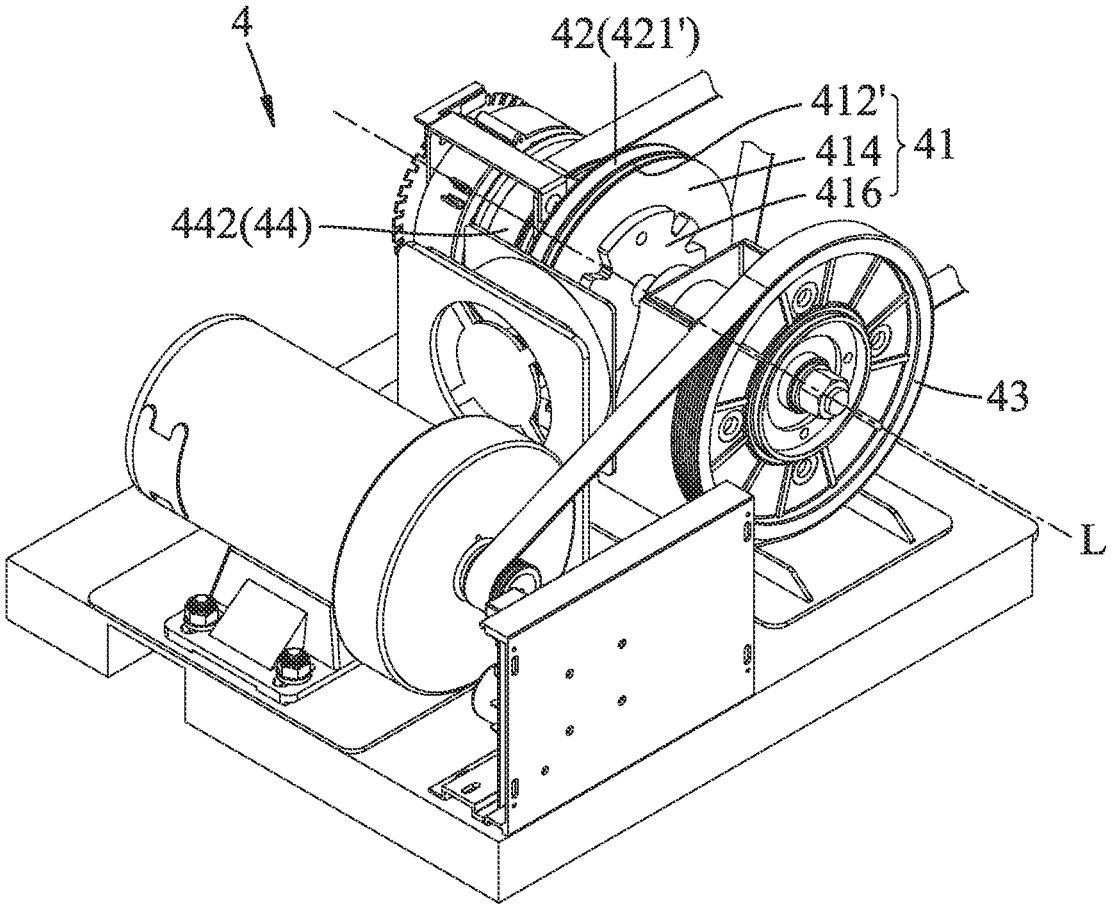
FIG. 7 is a perspective view of a resistance device of a resistance training machine according to the second embodiment of the present disclosure.
Figure 8:
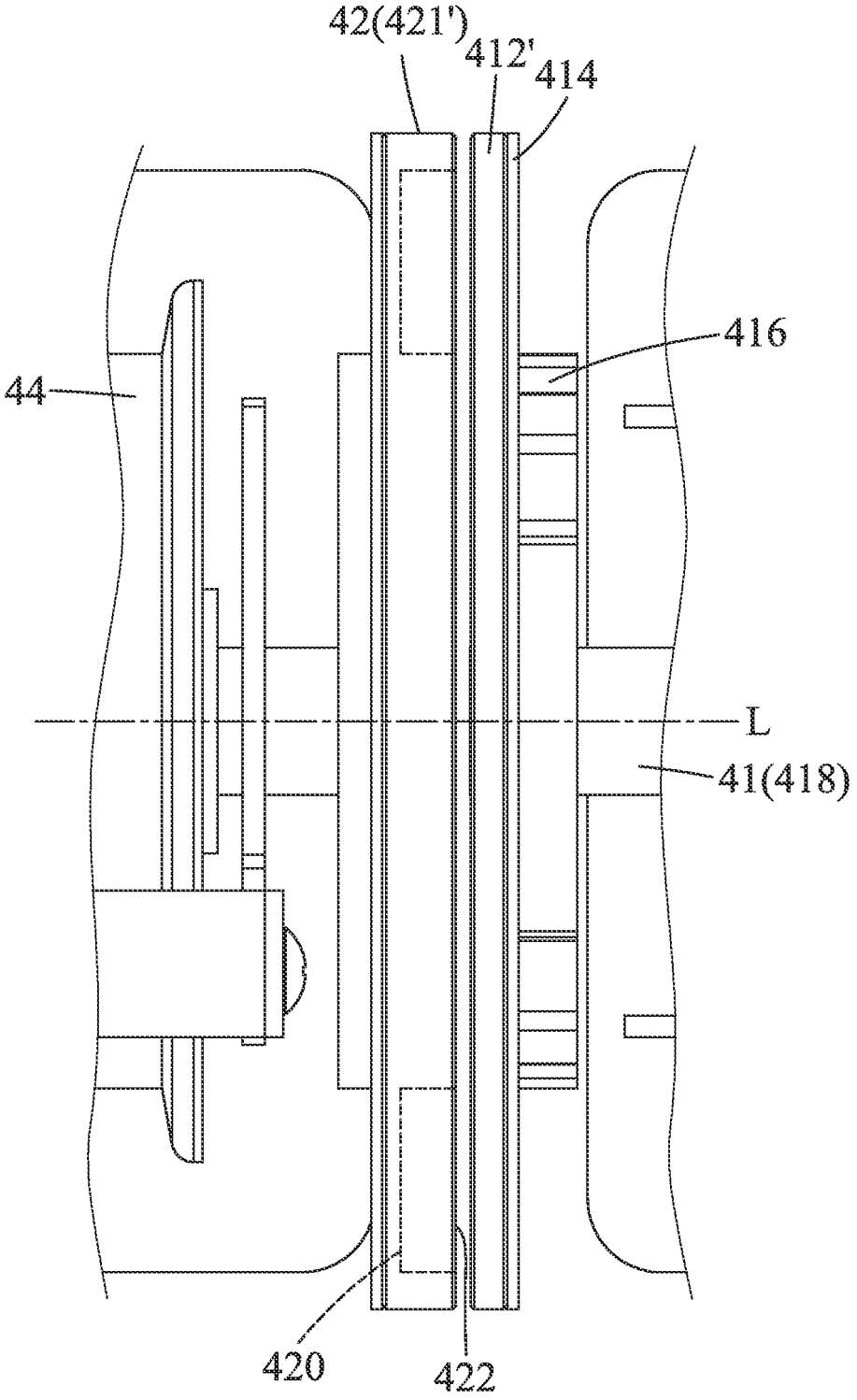
FIG. 8 is a fragmentary top view of the second embodiment, illustrating the structure of a first rotating member and a second rotating member.
Figure 9:
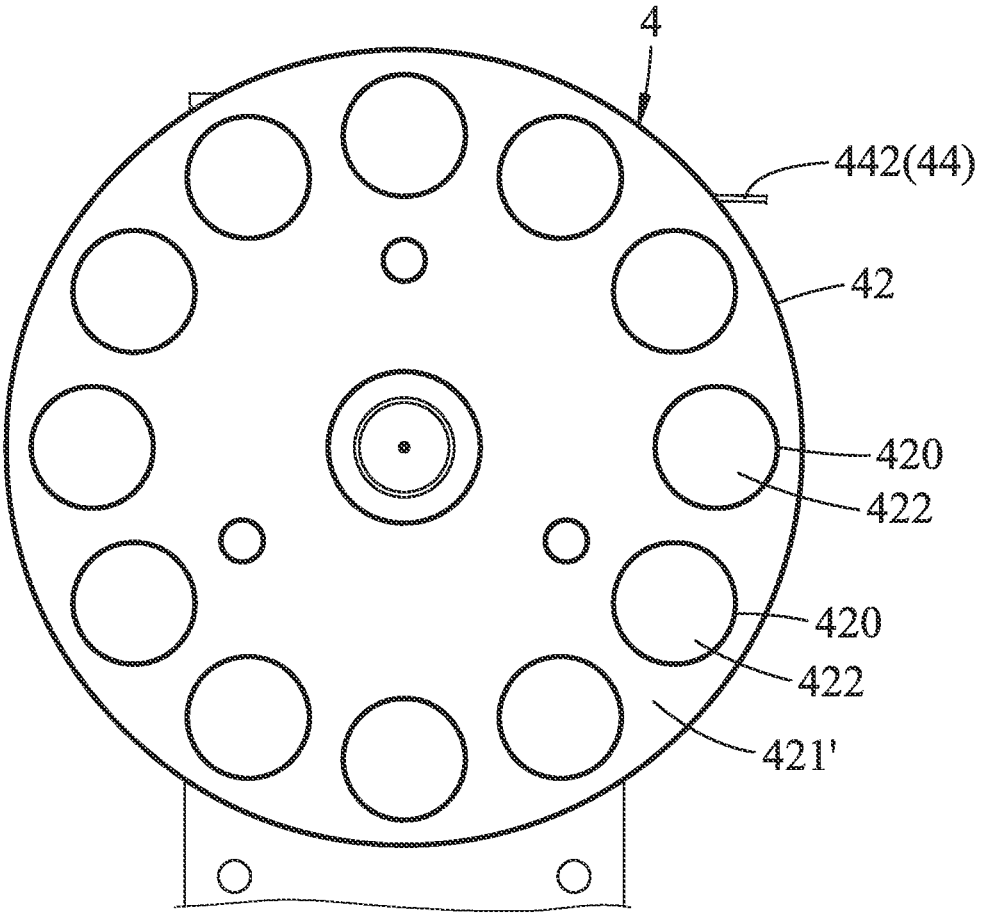
FIG. 9 is a side view of the second rotating member of the second embodiment.

Referring to FIGS. 7 to 9, the second embodiment of the resistance training machine of this disclosure is substantially identical to the first embodiment. Particularly, the resistance training machine includes the base 1, the seat 2, the operating device 3, the resistance device 4, and the meter device 5. However, the end plate 413 (see FIGS. 3 and 5) of the first rotating assembly 41 of the resistance device 4 of the first embodiment is replaced with a magnetic conductive disc 414 in this embodiment, and the first rotating member 412' of this embodiment is a conductive disc made of a material, such as aluminum, copper, aluminum alloy or copper alloy. The first rotating member or conductive disc 412' has a first surface and a second surface opposite to each other along the axis (L). The magnetic conductive disc 414 has one side connected to the connecting plate 416, and the other opposite side adhered to the first surface of the conductive disc 412'. The magnetic conductive disc 414 can be made of iron.

Further, in this embodiment, the second rotating member 421' of the second rotating assembly 42 is a disc-shaped magnet holder having a surface that faces the second surface of the conductive disc 412' and that is formed with a plurality of angularly spaced-apart circular grooves 420 surrounding the axis (L). The magnets 422 are respectively disposed in the circular grooves 420. The N and S poles of the magnets 422 are alternately arranged around the surface of the second rotating ring or magnet holder 421', and face the conductive disc 412'. Each magnet 422 is spaced apart from the conductive disc 412' by a radial gap of, for example, 2 mm.

The drive unit 43 can similarly drive the first rotating assembly 41 to rotate about the axis (L) and generate eddy currents in the conductive disc 412' through the relative rotation of the conductive disc 412' and the magnets 422. Hence, through the change of the magnetic field, a mutual braking resistance between the conductive disc 412' and the second rotating member 42 is created.

In the second embodiment, because the magnetic conductive disc 414 is located on the first surface of the conductive disc 412' and is opposite to the magnets 422, it can guide the magnetic field lines of the magnets 422 to concentrate and pass through the conductive disc 412', thereby improving the effect of cutting the magnetic field lines of the magnets 422 when the conductive disc 412' rotates, and thereby increasing the magnitude of the generated eddy currents and resistance. In other embodiments, the first rotating assembly 41 may not include the magnetic conductive disc 414, and can still achieve the effect of generating eddy currents and resistance.

Through an actual test of the second embodiment, when the speed of the motor 431 of the drive unit 43 is 357 rpm (revolution per minute), the resistance of the transmission belt 442 is 9.2 kgs.; and when the speed of the motor 431 is 2051 rpm, the resistance of the transmission belt 442 is 26.2 kgs. Thus, the resistance device 4 of this disclosure can indeed achieve the effect of providing resistance by driving the first rotating assembly 41 to rotate through the drive unit 43. At the same time, the resistance can be adjusted by adjusting the rotational speed of the first rotating assembly 41 driven by the drive unit 43.

Through the aforesaid description, the advantages of this disclosure can be summarized as follows:

1. According to the received control signal, the drive unit 43 can drive rotation of the first rotating assembly 41 (or the second rotating assembly 42), so that the conductive first rotating member 412, 412' and the second rotating member 421, 421' provided with the magnets 422 can rotate relative to each other, and eddy currents are generated in the first rotating member 412, 412', which in turn, provides resistance to the transmission unit 44. The resistance device 4 can control the rotational speed of the first rotating assembly 41 (or the second rotating assembly 42) through the control signal so as to provide a continuous and stable resistance, and can adjust the magnitude of resistance during the training process according to the actual requirements, thereby improving the convenience of use of this disclosure and simultaneously reducing the sound generated during training.

2. With the provision of the resistance device 4, and by connecting the transmission unit 44 to the operating device 3, the transmission unit 44 can provide resistance to operation of the operating device 3, so that the user can perform resistance training by operating the operating device 3. At the same time, according to the training needs (for example, anaerobic muscle strength training for specific muscle groups, such as hands, legs, back or chest, or lower intensity resistance training used in the field of rehabilitation medicine) in coordination with different forms of the operating device 3, a good training effect can be obtained.

3. With the provision of the sensing unit 45 and the meter device 5 for the user to monitor information, the convenience of use of this disclosure can be improved. At the same time, the above information can be used to further plan a suitable training program to improve the effectiveness of training.

4. With the provision of the control unit 46, the rotational speed of the drive unit 43 for driving rotation of the first rotating assembly 41 (or the second rotating assembly 42) can be controlled, so that the control unit 46 can adjust the rotational speed of the drive unit 43 according to the setting of the user so as to change the magnitude of resistance. Hence, the convenience of use of this disclosure can be further improved.

5. By integrating digital signals, the control unit 46 and the meter device 5 can be integrated into a control panel, or by connecting the signals of the control unit 46 and the sensing unit 45 to a remote software program (such as a mobile phone APP), the information can be monitored and the resistance can be adjusted at the same time, thereby further improving the convenience of use of this disclosure.

6. With the provision of the heat dissipating fan 47, the heat dissipation effect of this disclosure can be achieved, thereby assisting the resistance device 4 to provide the user with continuous and stable resistance and to avoid the problem of decreasing the resistance when overheated and affecting the training effect.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A resistance device, comprising:

a first rotating assembly rotatable about an axis and including a first rotating member that is conductive;

a second rotating assembly including a second rotating member spaced from said first rotating member, and a plurality of magnets arranged on said second rotating member at intervals around the axis, N and S poles of said magnets being alternately arranged on said second rotating member and facing said first rotating member, said first rotating member being influenced by said magnets to generate eddy currents during rotation of said first rotating assembly and said second rotating assembly relative to each other in order to brake rotation of said first rotating assembly and said second rotating assembly relative to each other;

a transmission unit connected to one of said first rotating assembly and said second rotating assembly for driving rotation of said one of said first rotating assembly and said second rotating assembly; and a drive unit connected to another one of said first rotating assembly and said second rotating assembly, said drive unit being configured to receive a control signal and being configured to drive rotation of said another one of said first rotating assembly and said second rotating assembly according to the received control signal;

wherein the eddy currents generated by said first rotating member during rotation of said first rotating assembly and said second rotating assembly relative to each other provide resistance to said transmission unit;

wherein said first rotating member is a conductive disc having one surface facing said magnets; and wherein said first rotating assembly further includes a magnetic conductive disc located on another surface of said first rotating member that is opposite to said magnets.

2. The resistance device as claimed in claim 1, wherein said drive unit is connected to said first rotating assembly, and said first rotating assembly further includes an end plate connected to said drive unit, said magnets being disposed on an outer peripheral surface of said second rotating member, said first rotating member being a rotating ring that is connected to said end plate at a side opposite to said drive unit and that is sleeved on and spaced apart from said second rotating member such that an inner peripheral surface of said first rotating member faces said magnets.

3. The resistance device as claimed in claim 2, wherein said first rotating assembly further includes an annular ring that surrounds the axis, that is connected to an outer periphery of said end plate and that abuts against an outer peripheral surface of said first rotating member, said annular ring being made of a magnetic conductive material.

4. The resistance device as claimed in claim 1, further comprising a control unit communicably connected to said drive unit and outputting the control signal to control a rotational speed of said drive unit for driving rotation of said other one of said first rotating assembly and said second rotating assembly.

5. The resistance device as claimed in claim 1, wherein said transmission unit includes a transmission wheel connected to said one of said first rotating assembly and said second rotating assembly, a transmission belt wound on said transmission wheel, and a restoring member connected to said transmission wheel, said transmission belt being pulled out of said transmission wheel to drive said transmission wheel to rotate, which in turn, drives said one of said first rotating assembly and said second rotating assembly to rotate therewith, said restoring member providing a restoring force to drive said transmission wheel to wind back said transmission belt.

6. The resistance device as claimed in claim 1, further comprising a heat dissipating fan for dissipating heat generated by said first rotating assembly and said second rotating assembly.

7. A resistance training machine comprising:

a base;

an operating device disposed on said base; and said resistance device as claimed in claim 1, said resistance device being disposed on said base, said transmission unit of said resistance device being connected to said operating device for providing resistance to operation of said operating device.

8. The resistance training machine as claimed in claim 7, further comprising a seat disposed on said base, said operating device including a foot plate assembly and a handle assembly connected to said transmission unit, wherein, when said foot plate assembly and said handle assembly are operated, said foot plate assembly and said handle assembly will drive said transmission unit to rotate, which in turn, drives said one of said first rotating assembly and said second rotating assembly to rotate therewith.

* * * * *